US007416406B2

(12) United States Patent
Schubach

(10) Patent No.: US 7,416,406 B2
(45) Date of Patent: Aug. 26, 2008

(54) FURNACE FRAMEWORK SYSTEM WITH EXPANSION JOINT

(75) Inventor: Frank Schubach, E. 24221 Tum Tum Dr., Liberty Lake, WA (US) 99019

(73) Assignee: Frank Schubach, Spokane, WA (US)

( * ) Notice: Subject to any disclaimer, the term of this patent is extended or adjusted under 35 U.S.C. 154(b) by 112 days.

(21) Appl. No.: 11/528,848

(22) Filed: Sep. 27, 2006

(65) Prior Publication Data

US 2008/0076084 A1 Mar. 27, 2008

(51) Int. Cl.
*F27D 1/00* (2006.01)

(52) U.S. Cl. ..... 432/251; 432/247; 110/336

(58) Field of Classification Search ..... 432/62, 432/63, 247, 252, 251, 160, 176, 199, 212; 110/181, 182, 336
See application file for complete search history.

(56) References Cited

U.S. PATENT DOCUMENTS 1,453,662 A 5/1923 Dunham
3,043,055 A * 7/1962 Davey ..... 52/127.4
4,013,396 A 3/1977 Tenney
4,303,055 A 12/1981 Fixler
4,308,854 A 1/1982 Kroll
4,311,460 A * 1/1982 Lauersdorf et al. ..... 432/247
4,385,621 A 5/1983 Kroll
4,392,820 A 7/1983 Niederholtmeyer
4,797,089 A 1/1989 Schubach et al.
4,877,395 A 10/1989 Schubach et al.
5,240,405 A 8/1993 Schubach et al.
5,383,445 A * 1/1995 Dixon ..... 126/110 R
5,475,958 A * 12/1995 Josefsson et al. ..... 52/396.01
5,724,829 A 3/1998 Schubach et al.
6,132,203 A 10/2000 Masin
6,530,779 B1 * 3/2003 Slade et al. ..... 432/103
6,532,727 B1 3/2003 Lundgren
6,761,542 B2 7/2004 Ojima et al.

* cited by examiner

*Primary Examiner*—Gregory A Wilson
(74) *Attorney, Agent, or Firm*—Wells St. John P.S.

(57) ABSTRACT

Aspects of this invention include a furnace framework system which includes a framework with a first end piece, a second end piece and inter-connecting structural members operatively connecting the first end piece with the second end piece, with a combustion chamber housing and an exhaust manifold operatively attached to the framework by at least one expansion joint to allow limited relative movement between the combustion chamber housing and/or the exhaust manifold. The expansion joint may include a flange on at least one of the combustion chamber housing and the exhaust manifold retained between the first end piece and a structural retainer component.

9 Claims, 7 Drawing Sheets

FURNACE FRAMEWORK SYSTEM WITH EXPANSION JOINT

CROSS REFERENCE TO RELATED APPLICATION

This application does not claim priority from any other application.

TECHNICAL FIELD

This invention relates to a furnace framework system which includes an expansion or flex joint for use in furnaces, preferably waste oil burning furnaces.

BACKGROUND OF THE INVENTION

Furnaces of various types including waste oil furnaces or heaters have been around for many years and are constructed of numerous different types of framework configurations. The frameworks and furnaces are also constructed out of numerous different types of materials. Very generally, the furnace frameworks which are the subjects of aspects of this invention provide a framework for the relative disposition or placement of furnace components, which generally include a combustion chamber housing, an exhaust manifold and air transfer conduits or manifolds. These components are generally held or disposed relative to one another by a framework.

In the past, the various components such as manifolds and conduits have been welded to other framework members such as end pieces, flanges, connectors and the like, along most or all of the length of the interface. These prior furnace systems, and methods for assembling them, may lead to different problems or undesirable circumstances, such as an excessive cost in manufacturing if an excessive amount of welding is relied upon. These prior systems, likewise, do not provide sufficient tolerance or allowance for the movement or flex of one component relative to another during the heating and cooling cycle that furnaces, particularly waste oil furnaces, must endure. If one component is heated or expands before an adjacent component to which it is affixed, there can be unnecessary tensions and possible failures in the welds between the components.

In prior furnace systems in which substantial welding is utilized to affix or dispose the framework components together, it is more difficult to replace specific components of the system without having to replace the entire system or destroy other components.

It is therefore an objective of aspects of this invention to provide a furnace system, which may include an apparatus and/or a method, which reduces the welding required to assemble the furnace.

It is another objective of aspects of this invention to provide a furnace system in which an expansion joint is provided, which allows more relative movement between adjacent parts, which are disposed or fixed relative to one another as part of the furnace system.

While the invention was motivated in addressing some objectives, it is in no way so limited. The invention is only limited by the accompanying claims as literally worded, without interpretative or other limiting reference to the specification, and in accordance with the doctrine of equivalents.

Other objects, features, and advantages of this invention will appear from the specification, claims, and accompanying drawings which form a part hereof. In carrying out the objects of this invention, it is to be understood that its essential features are susceptible to change in design and structural arrangement, with only one practical and preferred embodiment being illustrated in the accompanying drawings, as required.

BRIEF DESCRIPTION OF THE DRAWINGS

Preferred embodiments of the invention are described below with reference to the following accompanying drawings.

FIG. 4 is an exploded elevation perspective view of the upper portion of the first end of the furnace system shown in FIG. 1;

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Figure 1:
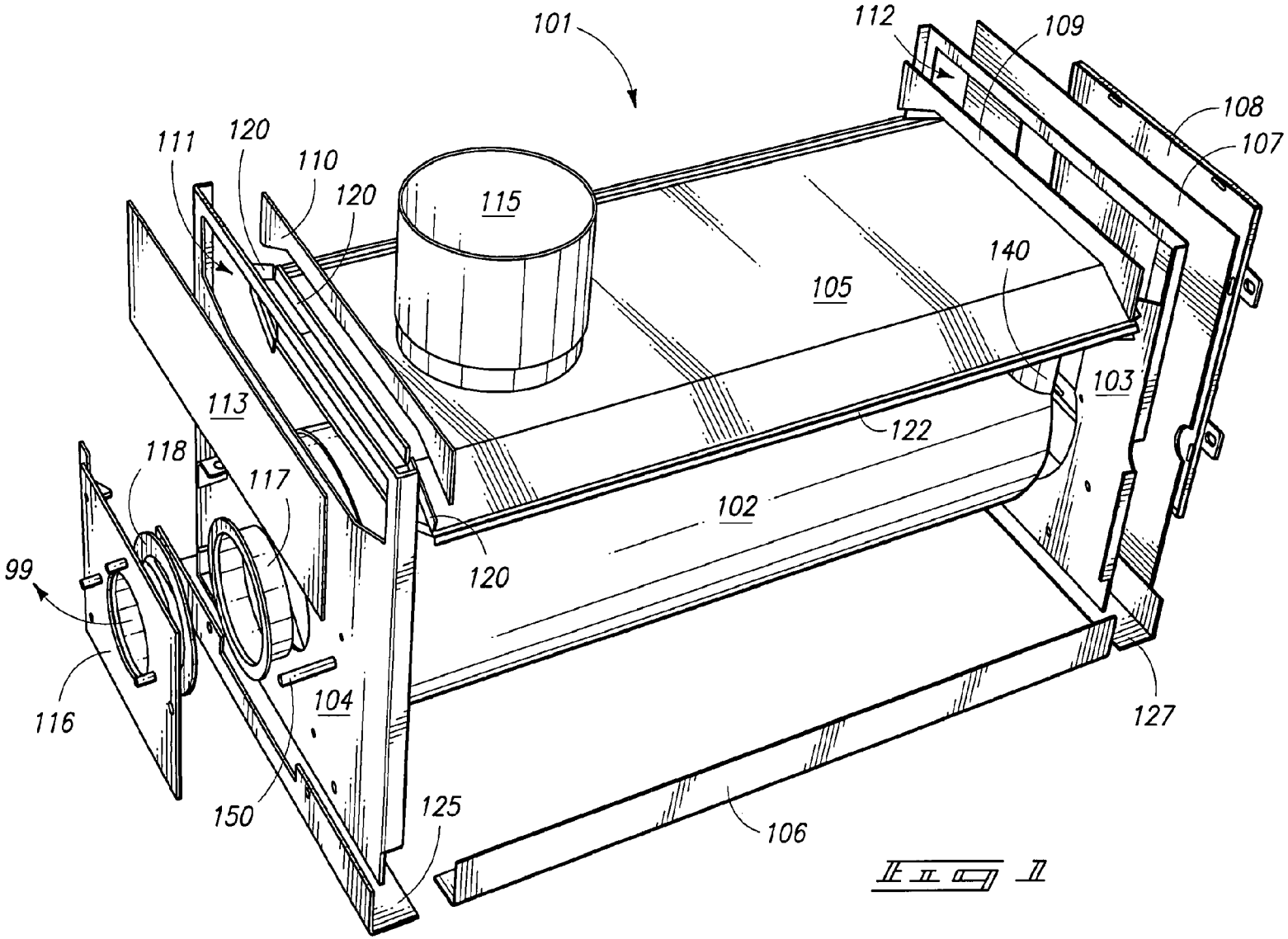
FIG. 1 is a perspective elevation view of one embodiment of a furnace system which may be utilized in practicing this invention.

FIG. 1 is a perspective elevation view of one embodiment of a furnace system 101 which may be utilized in practicing this invention. FIG. 1 illustrates exhaust manifold 105 with lower portion exhaust manifold 122, combustion chamber housing 102, exhaust manifold flange 120, which is a bent end of the exhaust manifold 105 and exhaust duct 115. The flange 120 is bent in a direction lateral to the exhaust manifold. A framework may include first end piece 104 attached to first end support 125, which is attached to lateral support 106 which in turn is attached to second end support 127. Second end piece 103 may be attached to second end support 127 and/or lateral support 106 to provide a general framework in which an exhaust manifold 105 and combustion chamber housing 102 may be disposed or retained.

In order to provide some of the benefits of certain aspects of this invention, the exhaust manifold first end may be bent outward (which would be upward and/or downward) to form an exhaust manifold flange 120. It is preferred to utilize upward and downwardly oriented flanges. This exhaust manifold flange 120 can then be placed between other components which may be spot welded to parts of the furnace framework such as the first end piece 104. In the embodiment of the invention shown the exhaust manifold flange may be held between first end exhaust manifold retainer 110 (a structural retainer component) and first end piece 104, with spot welds or fasteners being utilized to attach first end exhaust manifold retainer 110 to first end piece 104. First end plate 113 may also be utilized if exhaust manifold flange 120 is placed on the outer side of end piece aperture 111, in which case first end plate 113 would be spot welded or otherwise fastened to first end piece 104 to retain or hold exhaust manifold flange 120 and exhaust manifold 105 relative to the general framework.

Holding the exhaust manifold in this way allows greatly reduced welding and relative movement of the components of the furnace to one another so that heat and cooling expansion and contraction and relative movement of parts may occur within limits. This will result in reduced failure and due to the reduced welding it will result in less expensive welding costs and the ability to more easily replace components of the furnace instead of the entire furnace.

FIG. 1 further shows second end piece 103 with second end piece aperture 112, second end exhaust manifold retainer 109, second end plate 107 and end cap 108. The exhaust manifold 105 is shown with a lower portion of the exhaust manifold 122, more fully illustrated in other figures.

Those of ordinary skill in the art will appreciate from FIG. 1 that alignment rods such as alignment rod 150 may be utilized to position or dispose components relative to one another and to align them for assembly. Alignment rod 150 may also be utilized as a securing bolt or retainer when end plate 116 is hinged and utilized as a door as well.

First flange 117 and second flange 118 may be utilized to attach and align end plate 116 with the internal cavity of the combustion chamber housing 102. Oil burner aperture 99 is shown in end plate 116, second flange 118 and first flange 117, providing a conduit or aperture to the internal chamber of the combustion chamber. It will be appreciated by those of ordinary skill in the art that any one of a number of different types of oil burners may be disposed relative to the oil burner aperture 99 to provide the burning fuel into the combustion chamber housing 102.

FIG. 1 also illustrates how in some aspects or embodiments of the invention, exhaust manifold 105 may be assembled or affixed together by non-welded means, that is the operative attachment of the lower portion 122 to the upper portion of exhaust manifold 105. The two parts of the exhaust manifold may be double rolled, and crimped or pressed to achieve the attachment.

Figure 2:
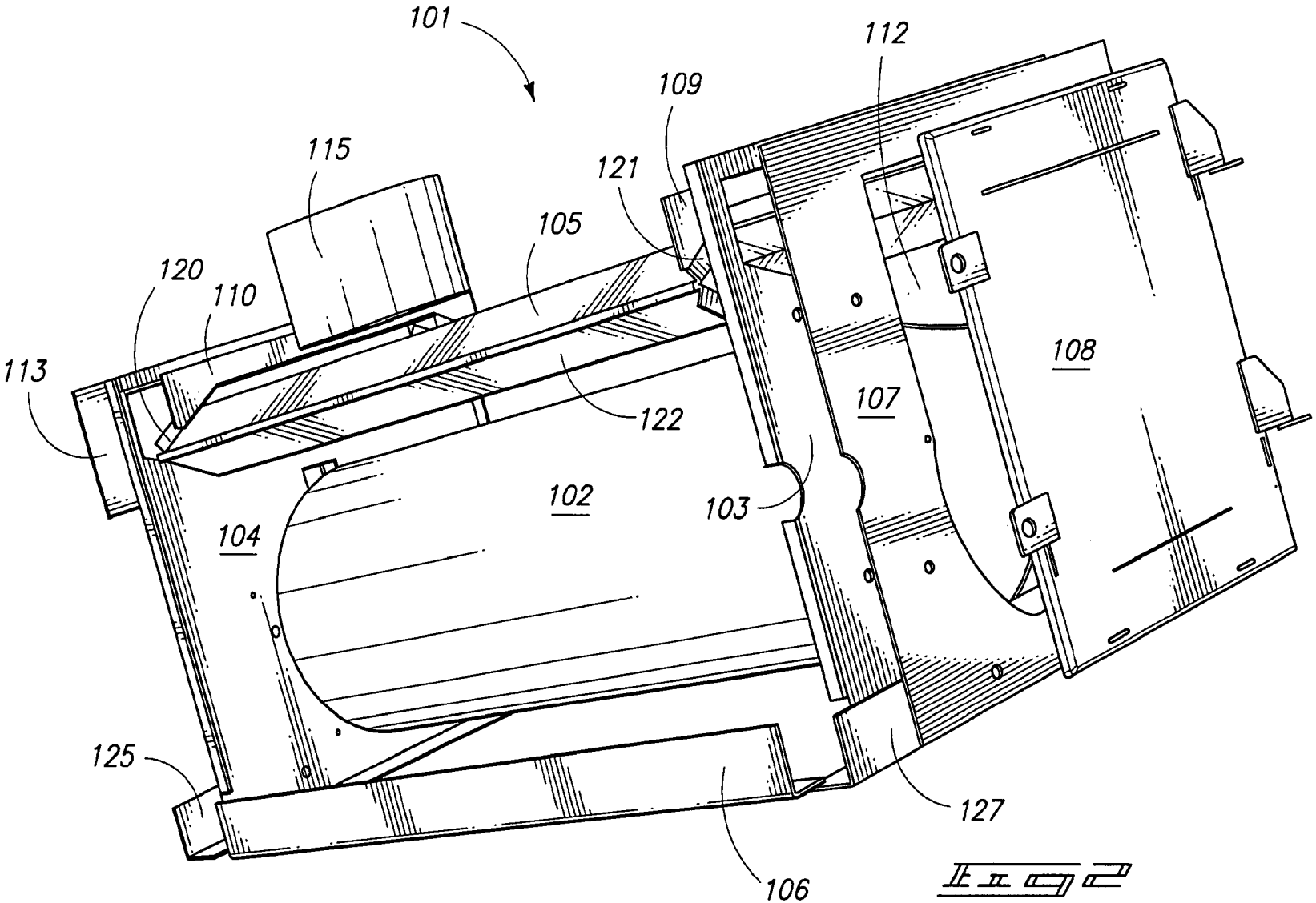
FIG. 2 is an exploded perspective view of the second end of the furnace system shown in FIG. 1.

FIG. 2 is an exploded perspective view of the second end of the furnace system 101, illustrating combustion chamber housing 102, exhaust manifold 105, lower portion of exhaust manifold 122, second exhaust manifold flange 121, second end exhaust manifold retainer 109, second end piece aperture 112, end cap 108, second end plate 107 and second end piece 103. End cap 108 may also be utilized as a door for access to the internal cavity of the combustion chamber for cleaning, service or other purposes. Second end support 127, lateral support 106 and first end support 125 are also shown relative to the above-reference components. First end piece 104 is shown at the far end of combustion chamber housing 102, with exhaust duct 115 shown above exhaust manifold 105. The exhaust manifold flange 120 at the first end of the furnace system is illustrated relative to first end exhaust manifold retainer 110 and first end plate 113.

Figure 3:
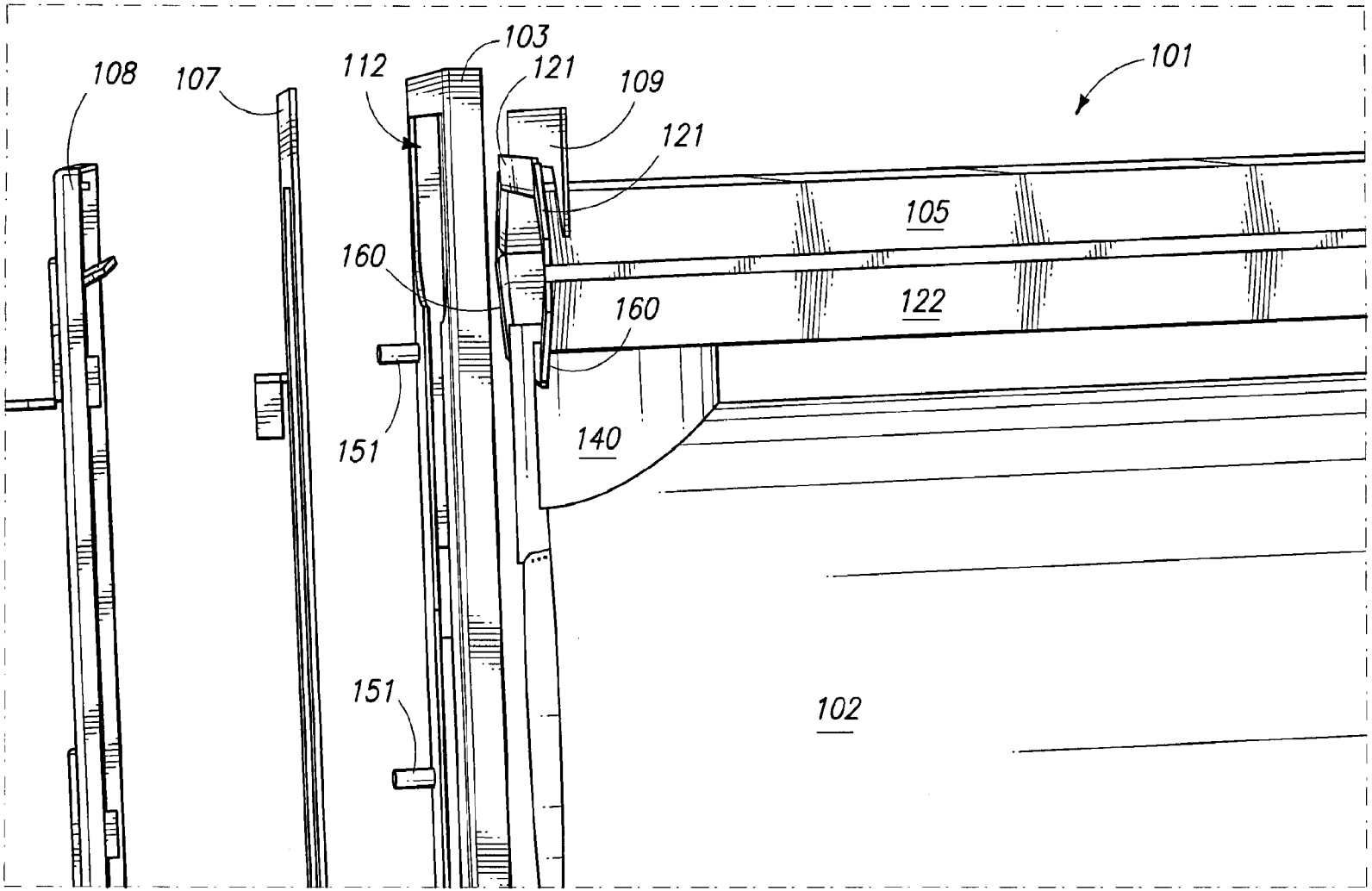
FIG. 3 is an exploded elevation view of the second end of the furnace system shown in FIG. 1.
Figure 11:
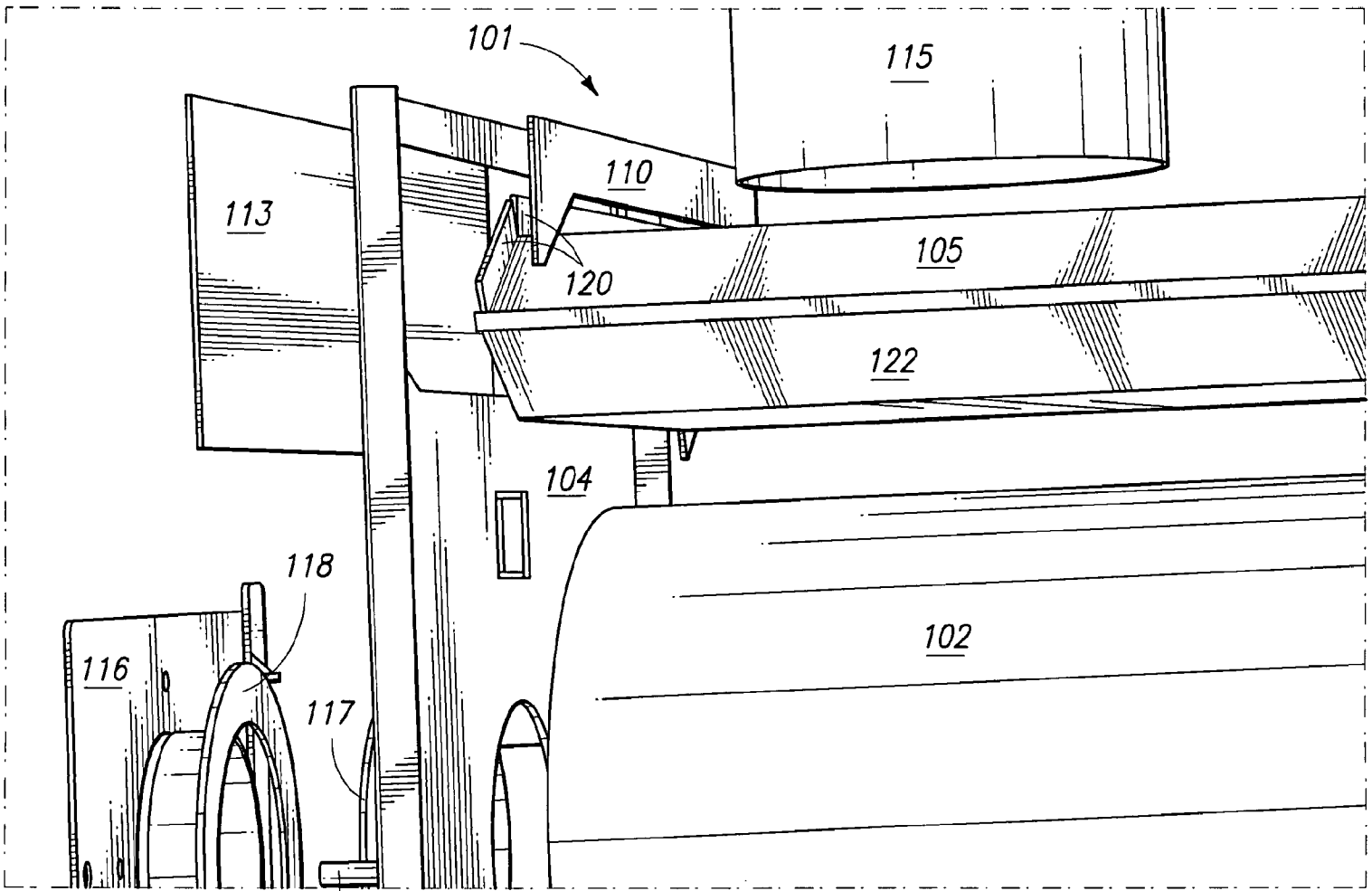

FIG. 3 is an exploded elevation view of the second end of the furnace system 101, illustrating combustion chamber housing 102, exhaust manifold 105, lower portion exhaust manifold 122, second exhaust manifold flange 121 with lower flanges 160 on the lower portion of exhaust manifold 122, second end piece aperture 112, second end piece 103, second end exhaust manifold retainer 109, second end plate 107, and end cap 108. Alignment rods 151 are shown extending through second end piece 103. Conduit structure 140 is shown providing a conduit between combustion chamber housing 102 and the exhaust manifold 105. End plates such as second end plate 107 may in some embodiments of the invention, be welded across the entire length thereof in order to provide a desired seal of exhaust gases and products of combustion.

FIG. 4 is an exploded elevation perspective view of the upper portion of the first end of the furnace system 101, illustrating combustion chamber housing 102, exhaust manifold 105, lower portion exhaust manifold 122, exhaust manifold flange 120, first end exhaust manifold retainer 110, first end plate 113, first flange 117, second flange 118, end plate 116 and alignment rod 150. First end piece 104 provides an end piece or framework for attachment of other components to provide the overall furnace system. Exhaust duct 115 is shown above exhaust manifold 105 in FIG. 4.

Figure 5:
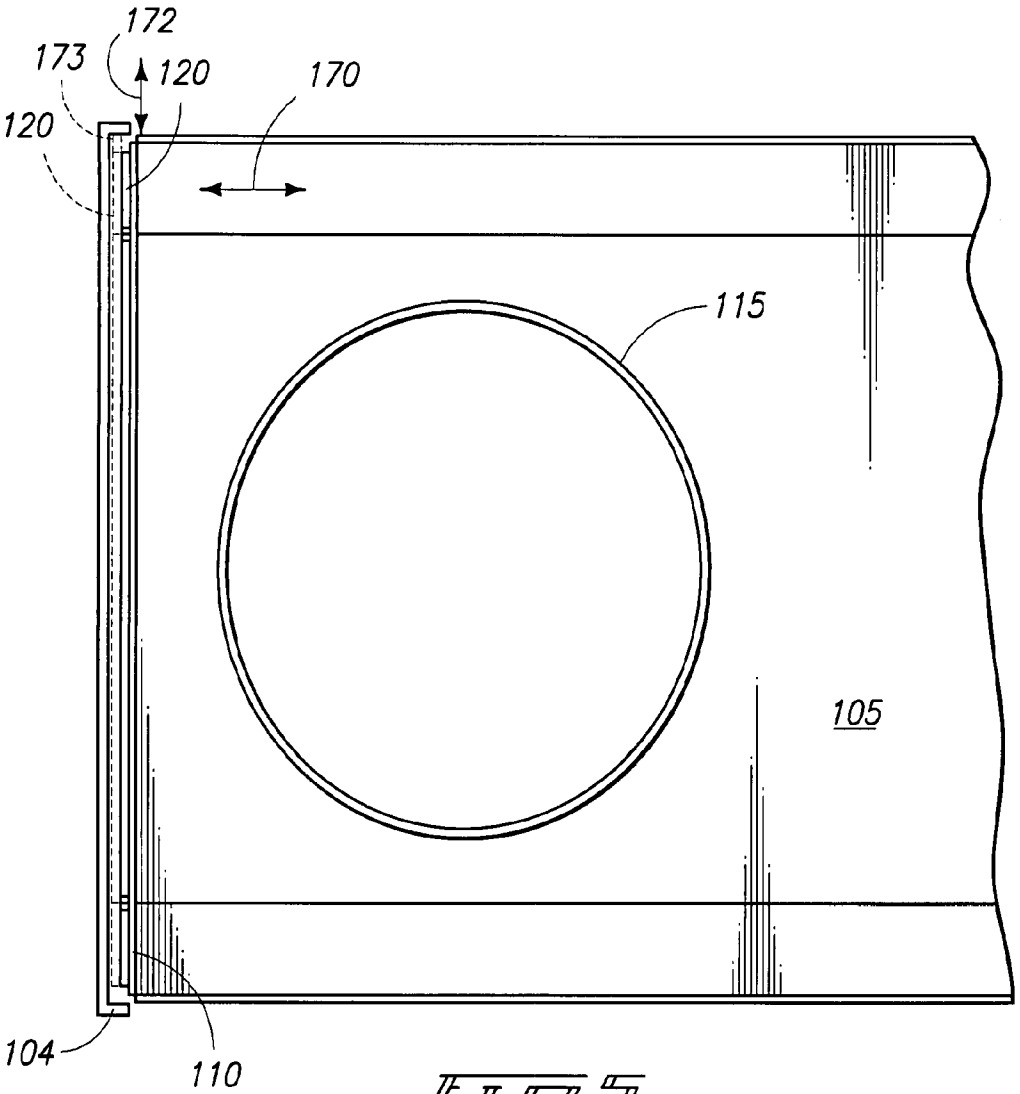
FIG. 5 is a top view of the furnace system shown in FIG. 1.

FIG. 5 is a top view of the furnace system illustrated in FIG. 1, showing exhaust duct 115, exhaust manifold 105, first end exhaust manifold retainer 110, first end piece 104, relative movement of exhaust manifold 105 is shown by arrow 170 and a second position of exhaust manifold flange 120 is shown by a dashed line within the expansion joint. It will also be appreciated by those of ordinary skill in the art that expansion or movement may not only occur in the direction shown by arrow 170, but also in the direction of arrow 172 and an extended dashed line 173 shows the relative movement of exhaust manifold flange 120 relative to first end piece 104 and exhaust manifold 105.

Figure 6:
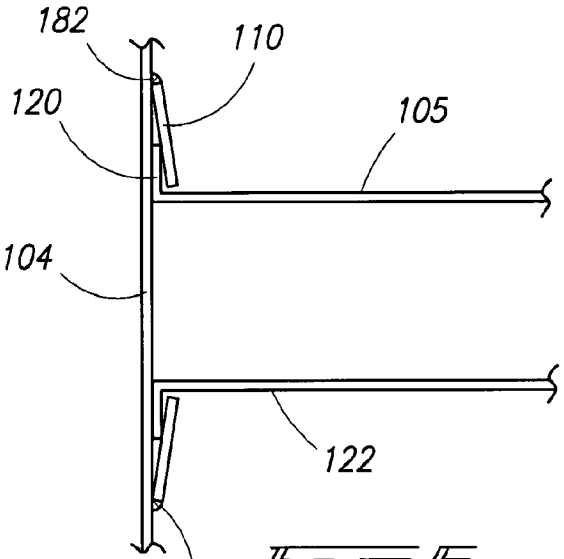
FIG. 6 is an elevation cross sectional schematic depiction of an embodiment of an expansion joint which may be utilized with this invention.

FIG. 6 is an elevation cross section schematic depiction of an embodiment of an expansion joint which may be utilized with this invention. Although common numbers are used for components, the view is changed and simplified to illustrate various options for providing an expansion joint for use with this invention. FIG. 6 for example, shows exhaust manifold 105 with lower portion exhaust manifold 122 and exhaust manifold flange 120 between first end piece 104 and first end exhaust manifold retainer 110. While FIG. 6 illustrates spot welds 182 being utilized to attach first end exhaust manifold retainer 110 to first end piece 104, this invention is not so limited and any one of a number of different types of fastening means or fasteners may be utilized, such as screws, full welds and the like.

Figure 7:
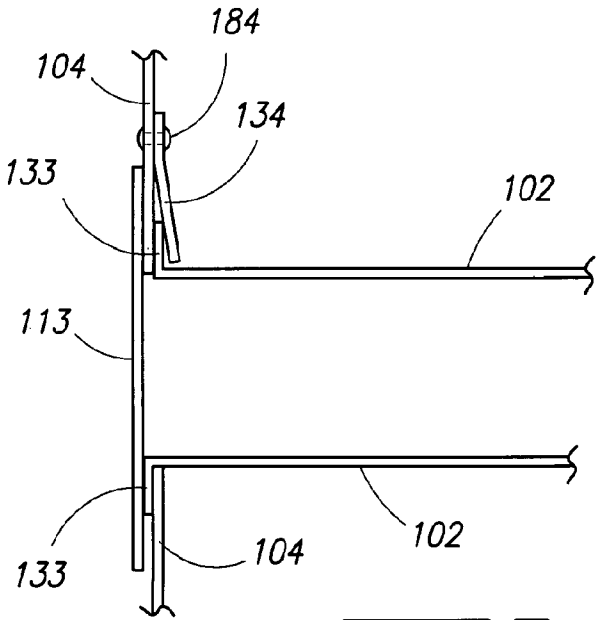
FIG. 7 is also an elevation cross sectional schematic view of an expansion joint which may be utilized with this invention.

FIG. 7 is also an elevation cross sectional schematic view of an expansion joint which may be utilized with this invention, showing first end piece 104, first end plate 113, combustion chamber housing 102 and combustion chamber housing flange 133 between first end combustion chamber housing retainer 134 and first end piece 104. The combustion chamber housing flange 133 may be retained or held in position by first end combustion chamber housing retainer 134 by the retainer being spot welded or otherwise fastened to first end piece 104. It will be appreciated by those of ordinary skill in the art that any one of a number of different methods of fastening means may be utilized to hold first end combustion chamber housing retainer 134 between first end combustion chamber housing retainer 134 and first end piece 104.

At the lower portion of FIG. 7, it shows a slightly different way to hold or retain combustion chamber housing flange 133 relative to first end piece 104, showing the combustion chamber housing 102 extending through the aperture in first end piece 104 and the combustion chamber housing flange 133 being on the outside of first end piece 104. In the lower example, first end plate 113 may be placed over combustion chamber housing flange 133 to hold it between first end plate 134 and first end piece 104 to retain or dispose it relative to first end piece 104. Again, it will be appreciated by those of ordinary skill in the art that first end plate 134 may be attached or fastened relative to first end piece 104 by spot welds or other fastening means which are known or may become known in the art.

While FIG. 7 shows a rivet 184 as a fastener, any one of a number of different types of fasteners may be utilized with no one in particular being required to practice this invention, such as screws, spot welds, bolts and nuts, and others.

Figure 8:
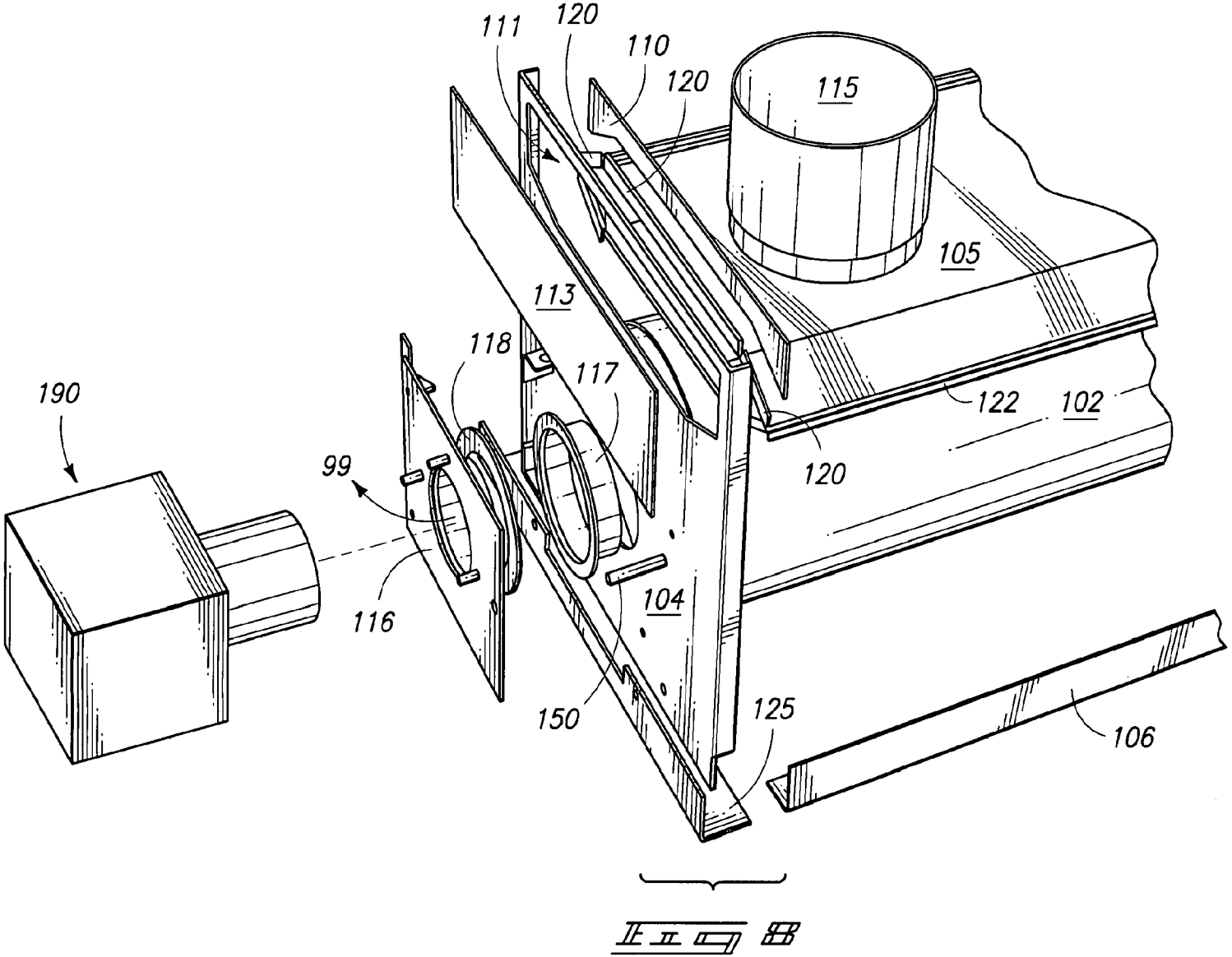
FIG. 8 is an exploded perspective view of the first end of the furnace system illustrated in FIG. 1, with the addition of a burner assembly shown.

FIG. 8 is an exploded perspective view of the first end of the furnace system illustrated in FIG. 1, with the addition of a burner assembly 190 shown. The components in FIG. 8 from FIG. 1 have been similarly numbered and each item or component identified or described above, and will not, therefore, be repeated here. The burner assembly 190 may be any one of a number of different types of assemblies, with no one in particular being required to practice this invention.

As will be appreciated by those of reasonable skill in the art, there are numerous embodiments to this invention, and variations of elements and components which may be used, all within the scope of this invention.

One embodiment of this invention, for example, a furnace framework system may be provided which includes: a framework with a first end piece, a second end piece and interconnecting structural members operatively connecting the first end piece with the second end piece; a combustion chamber housing which includes an internal combustion chamber, a burner aperture at a first end and an exhaust conduit at a second end, the combustion chamber housing being operatively connected at a first end to the framework; an exhaust manifold which includes an outlet conduit at a first end and an inlet at a second end disposed to receive exhaust from the combustion chamber, the exhaust manifold being operatively connected to the framework; and wherein one of the combustion chamber housing and the exhaust manifold are operatively connected to the first end piece and to the second end piece of the framework by an expansion joint.

Further or additional embodiments of that described in the foregoing paragraph may be further wherein the expansion joint is comprised of a flange on at least one of the combustion chamber housing and the exhaust manifold retained between the first end piece and a structural retainer component. These embodiments may further be: wherein the flange on at least one of the combustion chamber housing and the exhaust manifold is retained between the first end piece and a structural retainer component via at least one spot weld between the first end piece and the structural retainer component; wherein the flange on at least one of the combustion chamber housing and the exhaust manifold is retained between the first end piece and a structural retainer component via at least one fastener securing the first end piece to the structural retainer component. This may also be configured wherein both of the combustion chamber housing and the exhaust manifold are operatively connected to the first end piece and to the second end piece of the framework by an expansion joint; and/or wherein one of the combustion chamber housing and the exhaust manifold are operatively connected to the first end piece and to the second end piece of the framework by an expansion joint.

Embodiments of this invention may include those general configurations wherein the expansion joint allows relative movement between the exhaust manifold and the first end piece; and possibly further wherein the expansion joint allows relative movement between the combustion chamber housing and the first end piece.

These embodiments may, but need not, be such that the combustion chamber is configured to receive a waste oil burner.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A furnace framework system comprising:

a framework with a first end piece, a second end piece and inter-connecting structural members operatively connecting the first end piece with the second end piece;

a combustion chamber housing which includes an internal combustion chamber, a burner aperture at a first end and an exhaust conduit at a second end, the combustion chamber housing being operatively connected at a first end to the framework;

an exhaust manifold which includes an outlet conduit at a first end and an inlet at a second end disposed to receive exhaust from the combustion chamber, the exhaust manifold being operatively connected to the framework; and wherein one of the combustion chamber housing and the exhaust manifold are operatively connected to the first end piece and to the second end piece of the framework by an expansion joint.

2. A furnace framework system as recited in claim 1, and further wherein the expansion joint is comprised of a flange on at least one of the combustion chamber housing and the exhaust manifold retained between the first end piece and a structural retainer component.

3. A furnace framework system as recited in claim 2, and further wherein the flange on at least one of the combustion chamber housing and the exhaust manifold is retained between the first end piece and a structural retainer component via at least one spot weld between the first end piece and the structural retainer component.

4. A furnace framework system as recited in claim 2, and further wherein the flange on at least one of the combustion chamber housing and the exhaust manifold is retained between the first end piece and a structural retainer component via at least one fastener securing the first end piece to the structural retainer component.

5. A furnace framework system as recited in claim 2, and further wherein both of the combustion chamber housing and the exhaust manifold are operatively connected to the first end piece and to the second end piece of the framework by an expansion joint.

6. A furnace framework system as recited in claim 2, and further wherein one of the combustion chamber housing and the exhaust manifold are operatively connected to the first end piece and to the second end piece of the framework by an expansion joint.

7. A furnace framework system as recited in claim 1, and further wherein the combustion chamber is configured to receive a waste oil burner.

8. A furnace framework system as recited in claim 1, and further wherein the expansion joint allows relative movement between the exhaust manifold and the first end piece.

9. A furnace framework system as recited in claim 1, and further wherein the expansion joint allows relative movement between the combustion chamber housing and the first end piece.

* * * * *